US006029549A

United States Patent [19]

Baker

[11] Patent Number: 6,029,549

[45] Date of Patent: Feb. 29, 2000

[54] SCREWDRIVER WITH MULTI-POSITION SHANK

[75] Inventor: David R. Baker, Fort Worth, Tex.

[73] Assignee: David Baker, Inc., Forth Worth, Tex.

[21] Appl. No.: 08/946,492

[22] Filed: Oct. 7, 1997

Related U.S. Application Data

[60] Provisional application No. 60/028,044, Oct. 9, 1996.

[51] Int. Cl.[7] ..... B25B 23/16; B25G 1/08

[52] U.S. Cl. ..... 81/439; 81/177.4

[58] Field of Search ..... 81/436–439, 490, 81/177.1, 177.2, 177.4

[56] References Cited

U.S. PATENT DOCUMENTS

| | | | |
|---|---|---|---|
| 2,674,286 | 4/1954 | Carson | 81/177.4 |
| 4,235,269 | 11/1980 | Kraus | 81/177.4 X |
| 4,273,173 | 6/1981 | Smith et al. | 81/438 X |
| 4,409,866 | 10/1983 | McBride | 81/177.2 |
| 4,449,559 | 5/1984 | Martinmaas | 81/177.4 |
| 4,924,733 | 5/1990 | McKenzie | 81/177.4 X |
| 5,638,727 | 6/1997 | Gringer | 81/177.4 X |

FOREIGN PATENT DOCUMENTS

| | | | |
|---|---|---|---|
| 681319 | 10/1952 | United Kingdom | 81/177.4 |
| 2032328 | 5/1980 | United Kingdom | 81/177.2 |

*Primary Examiner*—D. S. Meislin

*Attorney, Agent, or Firm*—Felsman, Bradley, Vaden, Gunter & Dillon, L.L.P.; James E. Bradley

[57] ABSTRACT

A screwdriver has a handle having a storage area for storing bits used with the screwdriver. The storage area consists of races formed in the handle that securely hold the extra bits so that they do not rattle and can be seen without removing them from the handle. The screwdriver also has an adjustable or multi-position shank so that the length of the shank can be increased or decreased as desired.

11 Claims, 6 Drawing Sheets

SCREWDRIVER WITH MULTI-POSITION SHANK

This application claims the benefit of U.S. Provisional Application No. 60/028,044, filed Oct. 9, 1996.

BACKGROUND OF THE INVENTION

1. Field of the Invention

This invention relates in general to tools, and in particular to screw-type drivers for driving threaded fasteners.

2. Description of the Prior Art

Screwdrivers used for tightening and loosening threaded screw fasteners are well known and usually consist of a shaft or shank having a handle at one end and a driving tip at the other end for engaging a head of the screw to be driven. Usually the shank and tip are integrally formed from a single piece of steel or other strong metal. The handle is usually formed of plastic, wood or other suitable material and is permanently joined to the shank. While these screwdrivers work well, certain jobs may require different sized or shaped tips, or may require a different shank length. Several screwdrivers therefore may be needed at a particular job site for driving different type screws encountered. One also may not be certain what particular type of screwdriver is needed for a certain job, but wants to be prepared for the different screws that they may confronted with. This requires that one have on hand a set of different screwdrivers that can be used for a variety of different jobs. Because each screwdriver has its own handle and shank, this can take up a relatively large amount of space, as well as add to the weight of the screwdrivers that must be carried around.

There are screwdrivers that utilize a single handle and shank, but that have a variety of different tips that can be interchanged on the shank. The shank is usually provided with some type of socket, with the tip being formed as a separate bit or similar device that can be inserted and removed from the socket. Because several different bits are provided with the screwdriver, and they are usually fairly small in size, it is not uncommon that the bits become lost or misplaced. For this reason, the handles on some screwdrivers are hollowed out at the end to provide a storage compartment where the extra bits can be stored. An end cap is usually provided to close off the storage compartment. Because the extra bits are usually held loosely within this compartment, they often tend to rattle around, creating a nuisance to the user. When it is desired to select a bit from the hollowed-out storage area, it is often difficult to see the bits so that the bits must be poured out or otherwise removed from the storage area so that the appropriate bit can be selected. This increases the likelihood that the bits will be dropped and eventually lost.

In some cases, the screwdrivers may be provided with a removable shank. A different tip can be provided at each end of the removable shank. By removing and inverting the shank, the screwdriver can be provided with at least two different tips. While removable shanks are known, there has not been a screwdriver that has an adjustable length shank that can be effectively secured to the handle.

What is therefore needed is a screwdriver that has an adjustable- length handle that can be effectively secured to the screwdriver handle. What is also needed is a screwdriver having replaceable tips and which provides an effective storage area for any spare tips so that the tips are securely held and can be easily located and that does not require other spare tips to be removed from the storage area.

SUMMARY OF THE INVENTION

A screw-type driver is provided that can be used for loosening and tightening threaded fasteners. The screw-type driver has a handle with a non-circular shank channel formed therein. An elongate shank with a non-circular cross section is configured to be received within the non-circular shank channel so that rotational movement of the shank relative to the handle is prevented while allowing longitudinal movement of the shank within the shank channel. The shank has at least one retaining slot formed along the shank. A shank retaining member is mounted to the handle. The shank retaining member is movable between engaged and disengaged positions so that a portion of the retaining member projects into the shank channel when the retaining member is in the engaged position so that the retaining member engages the retaining slot to prevent longitudinal movement of the shank within the shank channel. In this way the shank is locked in place. The retaining member is disengaged from the retaining slot when the retaining member is moved to the disengaged position to allow longitudinal movement of the shank within the channel.

The shank may have a fastener engagement body releasably joined to the elongate shank for engaging a threaded fastener. The handle can be provided with a race for receiving the fastener engagement body. The race is sized and configured to frictionally hold the fastener engagement body for storage therein.

DETAILED DESCRIPTION OF THE INVENTION

Figure 1:
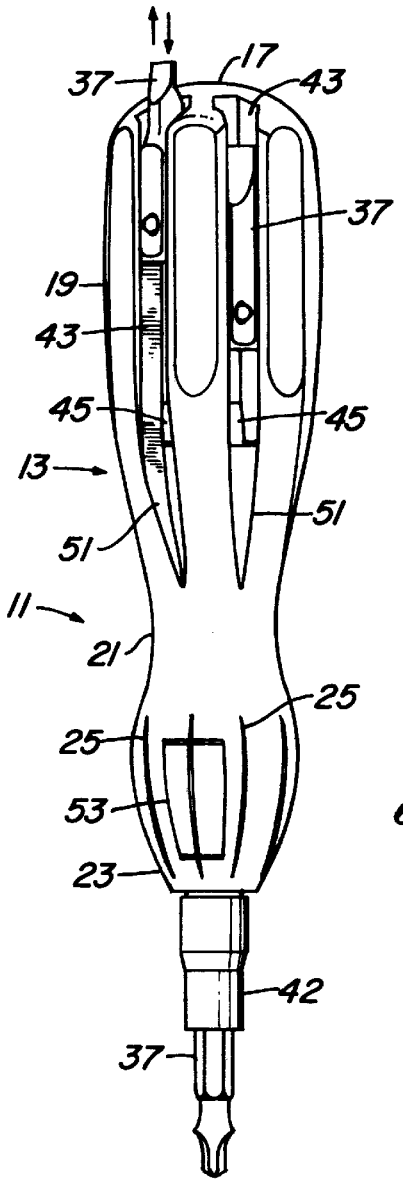
FIG. 1 is a perspective view of the screwdriver with multi-position shank constructed in accordance with the present invention.
Figure 2:
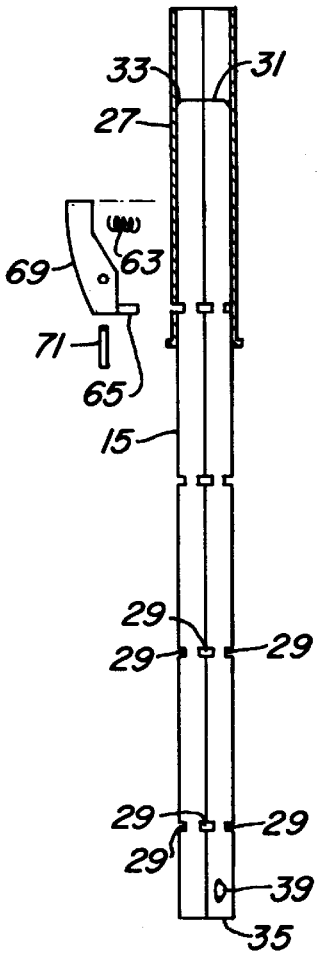
FIG. 2 is an elevational view of the multi-position shank of the screwdriver of FIG. 1.
Figure 3:
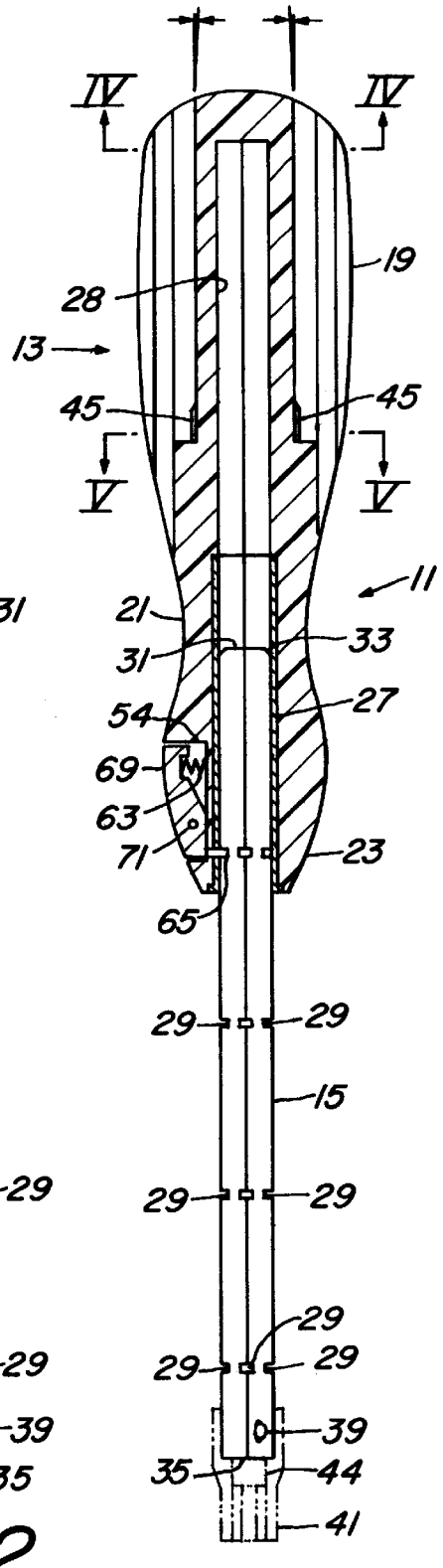
FIG. 3 is an elevational view of the screwdriver of FIG. 1 shown with a handle of the screwdriver in cross section.
Figure 4:
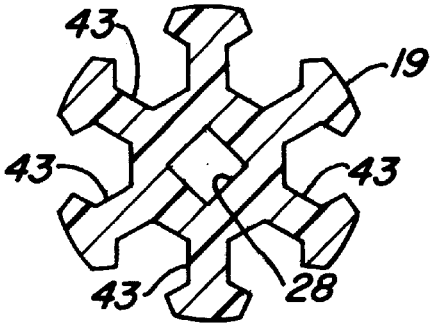
FIG. 4 is a transverse cross-sectional view of the screwdriver FIG. 3 taken along the lines IV—IV.
Figure 5:
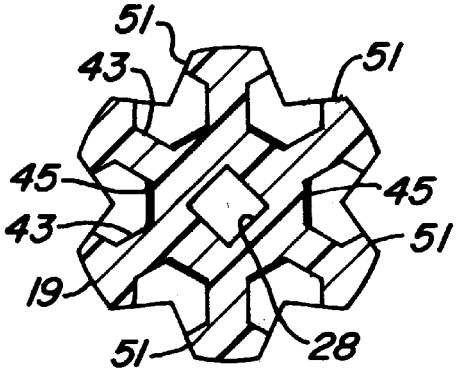
FIG. 5 is a transverse cross-sectional view of the screwdriver of FIG. 3 taken along the lines V—V.

Referring to FIGS. 1–3 in the drawings, numeral 11 illustrates a screwdriver with a multi-position shank of the present invention with a handle portion 13 which slidingly receives a multi-position shank 15. The handle portion 13 has a rounded heel portion 17, a barrel-shaped grip portion 19, a narrow neck portion 21, and a barrel-shaped nose portion 23. The handle portion 13 is preferably manufactured of die cast plastic. The grip portion 19 is generally hexagonal in cross-section and tapers inward from the heel portion 17 to the neck portion 21. The generally hexagonal cross-section of the grip portion 19 gradually transitions to the cylindrical cross-section of the neck portion 21. The neck portion 21 tapers outward to join the nose portion 23. A plurality of raised thumb ridges 25 run longitudinally along the nose portion 23 to enhance gripping.

The shank 15 has a square cross-section and is slidingly received by a shank sleeve 27 of similar cross-section which lines a portion of the interior of a square channel 28 which runs longitudinally along the axis of the handle portion 13 from the nose portion 23 towards the heel portion 17. The shank 15 and shank sleeve 27 are preferably made of steel, but may be made of non-conductive material for use in electrical applications. Shank adjustment notches 29, cut across each of the four corners of the shank 15, are selectively located along the shank 15. The butt end 31 of the shank 15 which is received in the shank sleeve 27 has bevels 33 to ease insertion of the shank 15 into the shank sleeve 27. The head end 35 of shank 15 has a conventional ball retainer 39 to receive and retain conventional ¼ inch drive sockets 41. A ¼ inch drive, ¼ inch hexagonal nut driver 42 receives conventional ¼ inch screwdriver bits 37. In an alternate embodiment of the shank 15, the head end 35 of the shank 15 includes a magnet 44 (FIG. 3) to magnetize either the ¼ inch drive sockets 41 or the ¼ inch nut driver 42.

Referring now to FIGS. 4–5, 8, and 10, screwdriver bits 37 are stored in a plurality of generally hexagonal bit races 43 which run through the heel portion 17 longitudinally along the exterior of the grip portion 19. The bit races 43 are slightly tapered inward from the heel portion 17 to frictionally hold the bits 37 snugly and prevent the bits 37 from falling out of the bit races 43. In addition to the slight taper of the bit races 43, each bit race terminates with an arcuate wedge 45 which runs longitudinally along the interior wall 47 of the bit race 43 to wedge smaller bits 37, or bits with no spring ball retainer, between the exterior walls 49 of the bit race 43 and the arcuate wedge 45.

Figure 9:
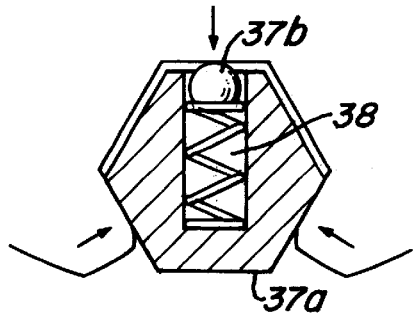
FIG. 9 is a transverse cross-sectional view of a bit in a bit race of the screwdriver of FIG. 1.
Figure 10:
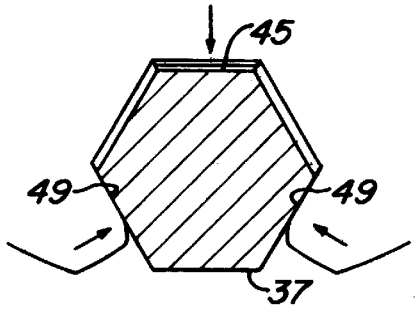
FIG. 10 is a transverse cross-sectional view of a bit in a bit race of the screwdriver of FIG. 1.
Figure 11:
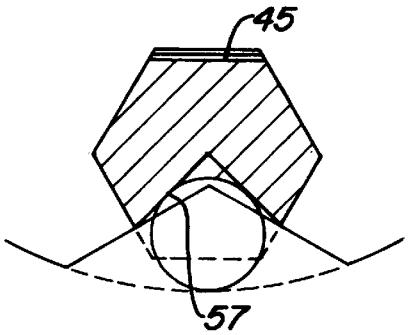
FIG. 11 is a transverse cross-sectional view of the base of a bit race of the screwdriver of FIG. 1.
Figure 12:
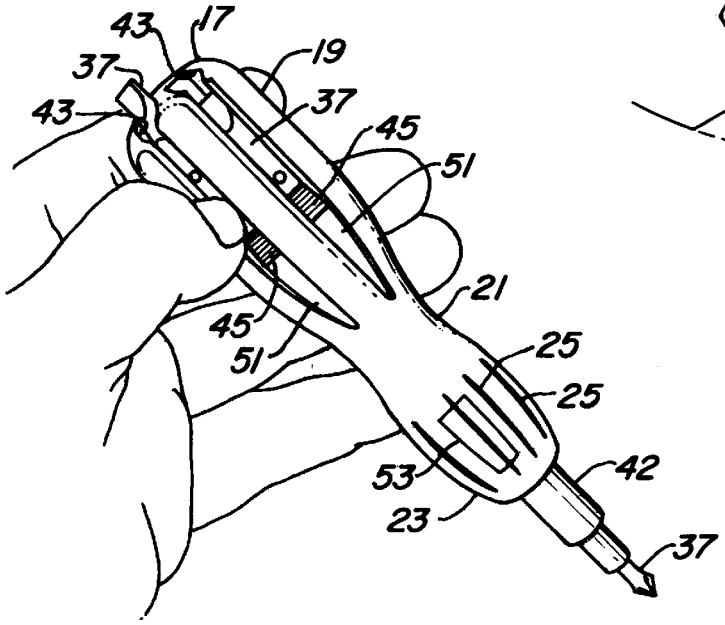
FIG. 12 is a perspective view of the screwdriver of FIG. 1, showing a user removing a bit race from the bit race.
Figure 13:
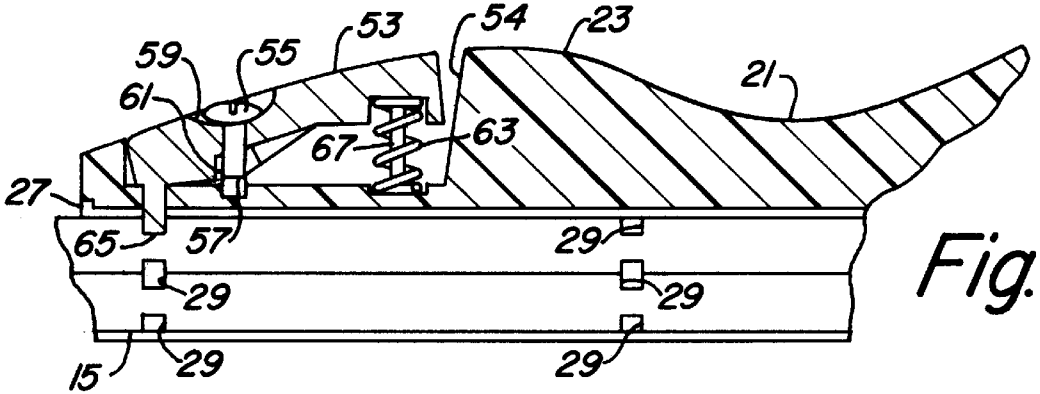
FIG. 13 is a cross-sectional view of the adjustment button of the screwdriver of FIG. 1.
Figure 15:
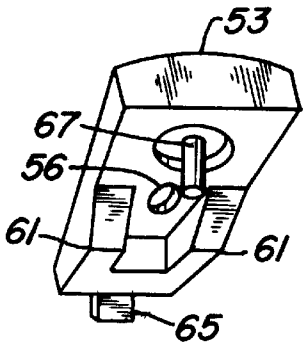
FIG. 15 is a bottom perspective view of the adjustment button of the screwdriver of FIG. 1.
Figure 14:
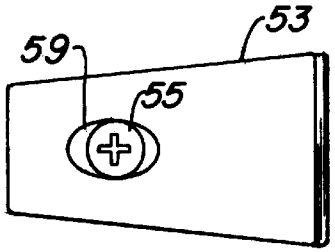
FIG. 14 is a top plan view of the adjustment button and adjustment screw of the screwdriver of FIG. 1.

FIG. 9 illustrates a bit 37*a* with a spring loaded retaining ball 37*b* housed within aperture 38 formed in the bit 37*a*. In the embodiment of FIG. 9, it is not necessary for the bit race 43 to utilize the arcuate wedge 45 to retain the bit 37*a*. The bits 37*a* are frictionally held in place by the force exerted against the bit race 43 by the spring ball 37*b*. The bit races 43 extend beyond the grip portion 19 and into the neck portion 21 to form recessed finger grooves 51 (as shown in FIG. 11). To change bits 37, the bit 37 is manually removed from the nut driver 42 and inserted into an available bit race 43 for storage. The desired bit 37 is then manually removed from the bit race 43 and inserted into the nut driver 42. Finger grooves 51 extending from the exterior of the handle 13 communicate with the races 43 to facilitate manual removal of the bits 37 from the wedged position between the arcuate wedge 45 and the exterior walls 49 of the bit race 43 (as shown in FIG. 12). The grooves 51 also allow the bits 37 to be viewed while stored in the races 43.

Figure 6:
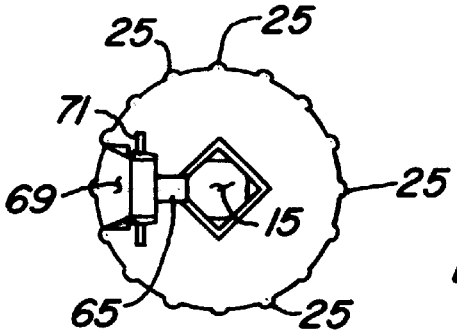
FIG. 6 is a schematic of the adjustment button of the screwdriver of FIG. 1.
Figure 7:
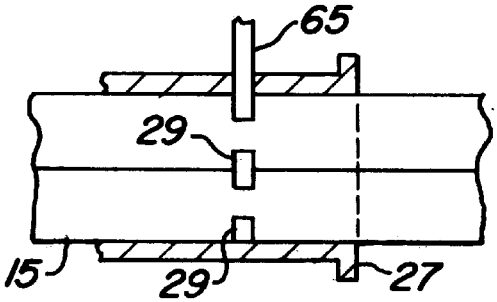
FIG. 7 is a schematic of the shank, shank sleeve, and latch tooth of the screwdriver of FIG. 1.
Figure 8:
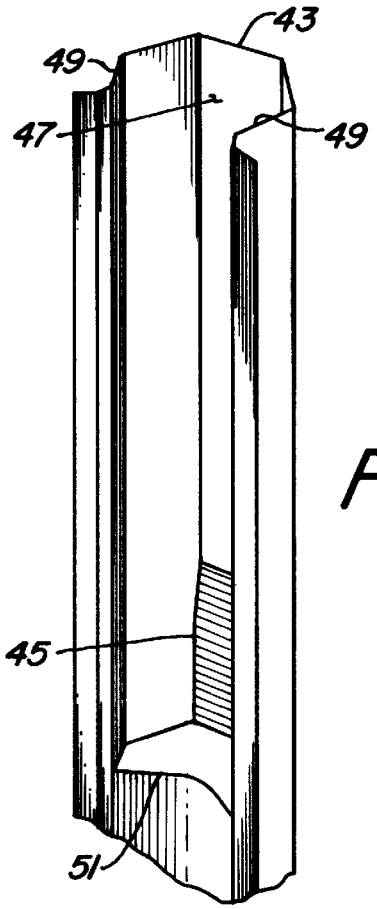
FIG. 8 is a perspective view of a bit race of the screwdriver of FIG. 1.

Referring now to FIGS. 7, and 13–15 in the drawings, shank adjustment button 53 is mounted to the nose portion 23 in recessed area 54 by adjustment screw 55, which passes through an aperture 56 in the adjustment button 53, such that adjustment button 53 is flush with nose portion 23. Adjustment screw 55 is received by threaded insert 57 which is permanently attached to the nose portion 23 in the recessed area 54. Aperture 56 opens into elliptical slot 59 so that when adjustment screw 55 is fastened into threaded insert 57, the adjustment button 53 is allowed to pivot about fulcrum 61. Spring 63 applies a force to the underside of adjustment button 53 at the rearward end to thereby producing a torque about the head of screw 55. This torque forces latch tooth 65 located at the opposite forward end of the button 53 through aperture (not shown) in shank sleeve 27 and into adjustment notch 29 of shank 15. The position of the shank 15 is adjusted by depressing the adjustment button 53 inward over the spring 63, thereby causing the latch tooth 65 to disengage from the adjustment notch 29 and allowing the shank to be slidingly adjusted within and relative to the shank sleeve 27 and the channel 28. It is preferable that a movement of the latch tooth 65 in the range of about 0.040 to 0.045 of an inch will disengage the latch tooth 65. Once the shank 15 is either removed from the shank sleeve 27 or adjusted such that another adjustment notch 29 aligns with the latch tooth 65, the adjustment button 53 is released, thereby allowing the latch tooth 65 to re-engage the adjustment notch 29 of the shank 15. Restrictor post 67 restricts the inward motion of the rearward end of the adjustment button 53 while disengaging the latch tooth 65. In an alternate embodiment, the adjustment button 53 and fulcrum 61 are replaced by pivot button 69 which pivots about pin 71 to disengage the latch tooth 65 (as shown in FIGS. 2–3 and 6).

FIGS. 16–21 show still another embodiment of a screwdriver 73. The screwdriver 73 is similar to the screwdriver 11 with some variations, which should be apparent to those with ordinary skill in the art. The screwdriver 73 has a handle 75 formed as two pieces 77, 79. The section 77 forms the neck or forward end of the handle 75. The rearward section 79 generally forms a grip of the handle 75 and may be formed from a softer or more resilient plastic or rubber material if desired. Alternatively, the handle 75 may be formed as a single piece of molded plastic or other suitable material.

A shank channel 83 extends longitudinally through the center of the handle 75 through its entire length. The channel 83 is lined with a metal shank sleeve 85 at the forward end 77 of the handle 75. The shank channel 87 has a non-circular cross section, such as a square or hexagon, for closely receiving the shank 81, the shank 81 having a corresponding non-circular cross section. This prevents rotational movement of the shank 81 relative to the handle 75, but allows the shank 81 to slide longitudinally within the shank channel 83.

The shank 81 is provided with a plurality of longitudinally spaced grooves or slots 87. The grooves 87 extend around the entire circumference of the shank 81 so that the shank 81 has a circular cross section where the grooves 87 are formed. At least one end of the shank 81 is provided with a spring ball retainer 89 for securing a socket 91, similar to the socket 41, so that a tip or bit 93 can be attached to the shank 81 for engaging a screw or other fastener. The bit 93 is provided with a tang 94 having a hexagonal cross section that corresponds to the opening of socket 91 and can also be used for driving hexagonal nuts. The tang 94 may also have a spring loaded ball 93*b* to facilitate retaining the tang 94 within the socket 91.

A metal end cap 95 is joined to the handle 75 by screws 97 and forms the nose or forward end of the handle 75. The end cap 95 has recesses 99, 101 (FIGS. 19–20) formed in its upper surface. When the end cap 95 is secured to the handle 75 the recess 99 forms a transverse slot 103 in the handle 75 in communication with the handle exterior. The slot 103 houses a shank retaining blade 105. The blade 105 is a generally flat steel or metal member oriented perpendicular to the shank channel 83 within the slot 103. The blade 105 is pivotally mounted about one of the screws 97 and has a hooked or concave portion 107 configured to engage the grooves 87 on the shank 81. One end of the blade 105 forms a leg 109 that engages an outwardly-biased coiled spring 111 that is received within the recess 101. A button or arm 113 located opposite the leg 109 projects from the slot 103 past the handle exterior to allow a user to grasp or access the arm 113.

Figure 16:
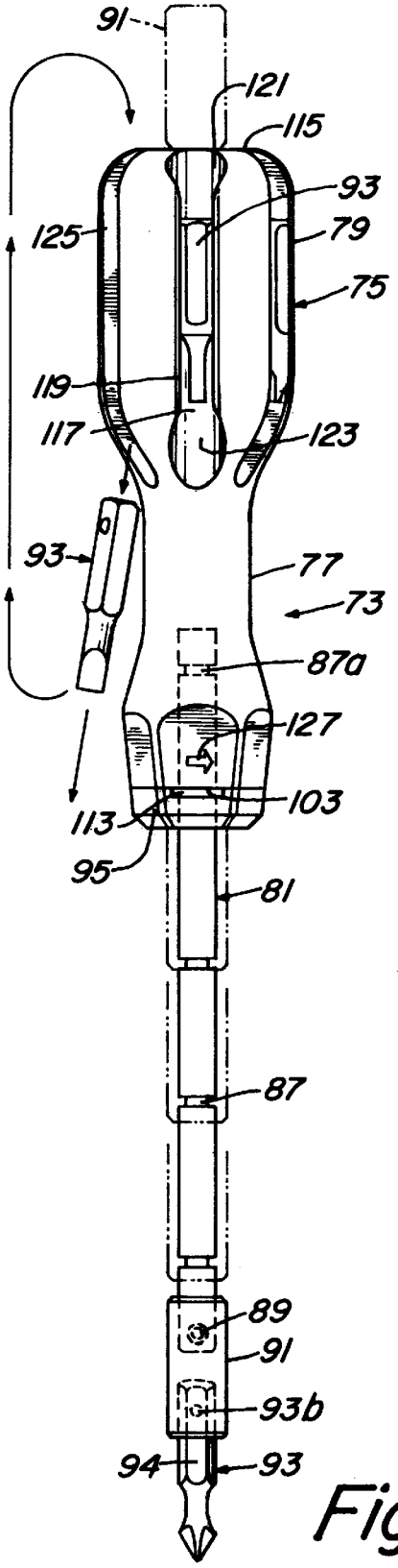
FIG. 16 is an elevational view of another embodiment of a screwdriver with a multi-position shank constructed in accordance with the invention.
Figure 17:
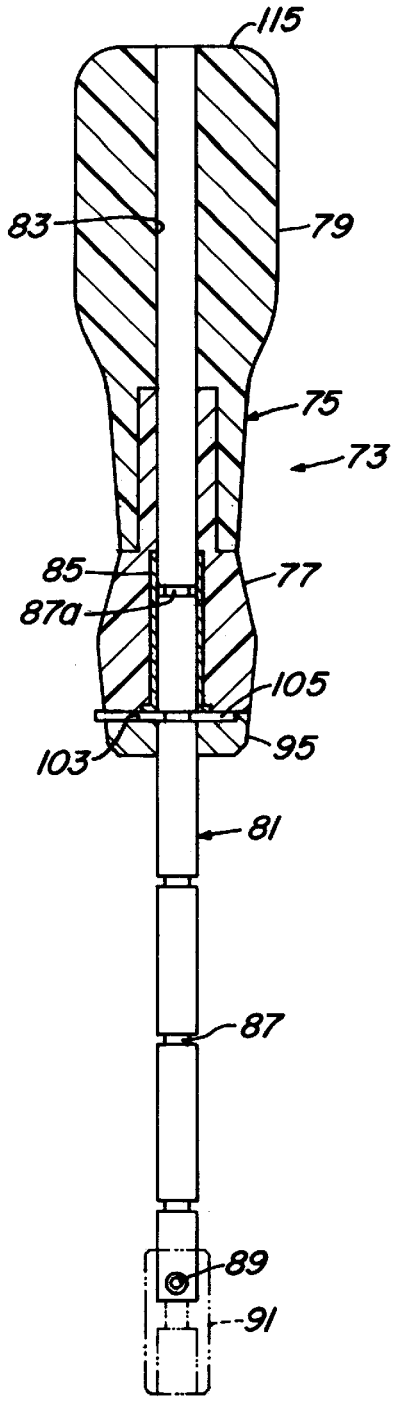
FIG. 17 is an elevational view of the screwdriver of FIG. 16 shown with a handle of the screwdriver in cross section.
Figure 18:
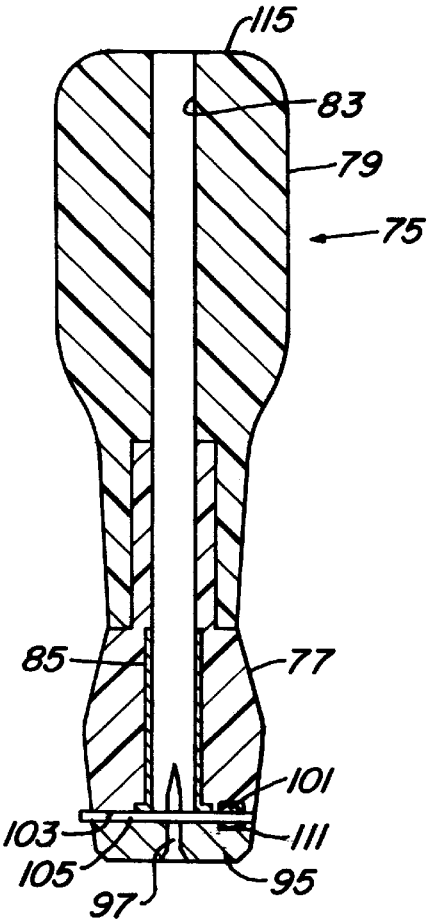
FIG. 18 is a cross-sectional view of a handle of the screwdriver of FIG. 16.
Figure 21:
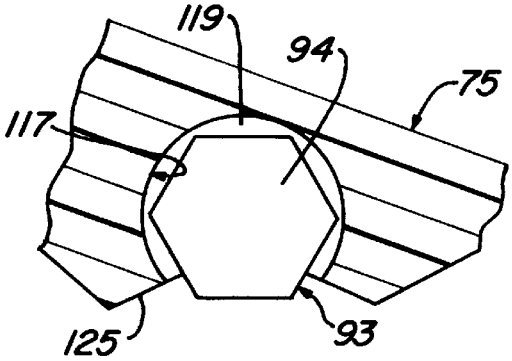
FIG. 21 is a transverse cross-sectional view of one of the bit races of the screwdriver of FIG. 16.
Figure 19:
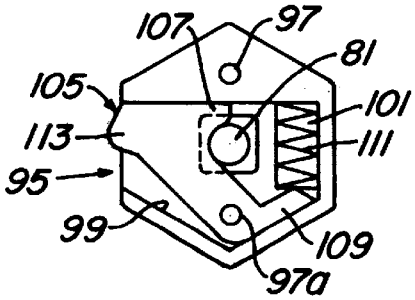
FIG. 19 is a plan view of a shank retaining member shown in engaged with a shank of the screwdriver of FIG. 16.
Figure 20:
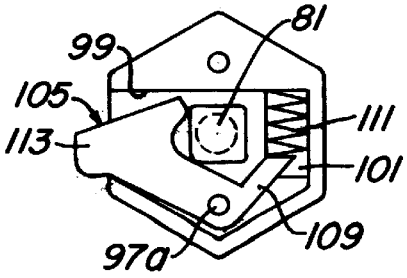
FIG. 20 is a plan view of the shank retaining member of FIG. 19, shown disengaged from the shank.

Referring to FIGS. 16–18, the rearward or grip portion 79 of the handle 75 terminates in a heel 115 and tapers radially inward toward the forward neck portion 77. Formed in the rearward portion 79 of the handle 75 are a plurality of circumferentially spaced races 117. For example, there may be six races 117 arranged in a hexagonal arrangement about the handle. The races 117 extend generally longitudinally along the handle 75. Provided in each of the races 117 is a metal race insert 119 that defines a hexagonal-shaped passage or interior sized to closely receive the bits 93 for storage. Openings 121, 123 of the races 117 are formed in the heel 115 and forward end of the grip portion 79, respectively, for insertion and removal of the bits 93. Longitudinal access or finger grooves 125 extend substantially the length of the races 117 and communicate between the exterior of the handle 75 and the interior of the races 117 so that bits 93 are visible and can be pushed through the races to either of the openings 121, 123. The grooves 125 have a width that is less than the width of the bit tang 73.

The operation of the screwdriver 73 is as follows. With the socket 91 secured to the end of the shank 81, a bit 93 is selected from a plurality of bits 73 stored within the races 117. The selected bit is pushed either rearward or forward through the race 117 and out one of the openings 121, 123, as shown in FIG. 16. The bit is then inserted into socket 91. After use, the bit 73 can then be reinserted into one of the races 117 through one of the openings 121, 123. The narrower neck portion 77 provides a clearance for inserting and removing the bit 73 through opening 123. The spring ball 93*b* acting against the sides of the race provide a snug friction fit so that the bit 73 is securely held therein.

The position of the shank 81 within the handle 75 is adjusted by first pressing the arm 113 of the shank retaining blade 105 in the direction of the arrow 127 (FIG. 16) so that the blade 105 is pivoted about its mounting screw 97*a*, causing the leg 109 to depress spring 111. This disengages the blade 105 so that it no longer projects into the channel 83 and the shank 81 can be slid freely within the channel 83 to a different position. When the desired position is selected, the arm 113 of the blade 105 is released. The spring 111 acting on leg 109 urges the blade 105 into an engaged position with the shank 81. If the blade 105 is not aligned with one of the grooves 87, the hooked portion 107 will rest against the shank exterior so that the shank 81 can still be slid within the shank channel 83. When one of the grooves 87 is eventually aligned with the blade 105, the spring 111 will urge the hooked portion 107 into the aligned groove so that the shank 81 is securely held within the handle 75. When longitudinal forces are directed against the shank 81, the forces will be applied to the retaining blade 105, which will then transmit the forces to the handle 75 through the edges of the slot 103.

It is also possible to completely remove the shank 81 from the handle 75 by disengaging the retaining blade 105, as described, and sliding the shank 81 from the channel 83. The handle 75 can also be inverted 180° and inserted into the channel 83 through the heel 115 of the handle 75 so that the retaining blade 105 engages the groove 87*a* located adjacent the very end of the shank 81 opposite the socket 91. This causes the socket 91 and bit 93 to extend from the rear of the handle 75, as shown by the dashed lines in FIG. 16, so that only a very small portion of the shank 81 extends from the handle 75 to thus form a short driver.

The screwdriver of the invention has several advantages over the prior art. The handle is configured to securely hold extra bits so that they do not rattle or serve as a distraction as in the prior art. The desired bit can be viewed without having to remove it from storage. The length of the shank can be easily adjusted and securely held in the desired position. It is even possible to insert the shank into either end of the handle.

It should be apparent from the foregoing that an invention having significant advantages has been provided. While the invention is shown in only one of its forms, it is not just limited but is susceptible to various changes and modifications without departing from the spirit thereof.

I claim:

1. A screw-type driver that can be used for loosening and tightening threaded fasteners, the screw-type driver comprising :

a handle having a non-circular shank channel and a generally transverse slot formed therein that intersects the shank channel;

an elongate shank, the shank having a non-circular cross section configured to be received within the non-circular shank channel so that rotational movement of the shank relative to the handle is prevented while allowing longitudinal movement of the shank within the shank channel, the shank having at least one retaining slot formed along the shank;

a shank retaining member mounted to the handle, the shank retaining member being moved between engaged and disengaged positions so that a portion of the retaining member projects into the shank channel when the retaining member is in the engaged position so that said portion engages the retaining slot to prevent longitudinal movement of the shank within the shank channel so that the shank is locked in place, and wherein said portion is disengaged from the retaining slot when the retaining member is moved to the disengaged position to allow longitudinal movement of the shank within the channel;

a fastener engagement body joined to the elongate shank for engaging a threaded fastener;

wherein the fastener engagement body is removably joined to the shank;

wherein the handle has a race formed therein for receiving the fastener engagement body, the race being sized and configured to frictionally hold the fastener engagement body for storage therein; and wherein the handle has a race access slot that communicates between the exterior of the handle and the race;

wherein the retaining member is closely received within the transverse slot so that longitudinal forces applied to the retaining member by the shank are transmitted to the handle; and wherein the retaining member includes a transverse blade pivotally mounted within the slot, the blade having an arm that projects beyond the handle exterior to facilitate movement of the blade to the disengaged position.

2. A screw-type driver that can be used for loosening and tightening threaded fasteners, the driver comprising:

a shank;

a fastener engagement body for engaging a threaded fastener, the fastener engagement body being releasably joined to the shank;

a handle joined to the shank, the handle having a race formed therein for receiving the fastener engagement body, the race being sized and configured to frictionally hold the fastener engagement body for storage therein;

wherein the fastener engagement body has a spring-loaded detent that bears against the race when the fastener engagement body is received therein to facilitate holding the fastener engagement body therein;

wherein the handle has a rearward grip portion terminating at a rearward end in a heel of the handle and tapering radially inward to a forward neck portion at the forward end, the race extending along the grip portion and having openings at the heel and forward end of the grip portion so that the fastener engagement body can be inserted and removed through the openings of the race, the forward neck portion defining a clearance for insertion and removal of the fastener engagement body; and wherein the handle has a race access slot that communicates between the exterior of the handle and the race along the length of the race to facilitate removal of a bit by engaging the bit with a user's thumb and sliding the bit toward said clearance.

3. A screw-type driver that can be used for loosening and tightening threaded fasteners, the screw-type driver comprising:

a handle having a non-circular shank channel;

an elongate shank, the shank having a non-circular cross section configured to be received within the non-circular shank channel so that rotational movement of the shank relative to the handle is prevented while allowing longitudinal movement of the shank within the shank channel, the shank having at least one retaining slot formed along the shank;

a shank retaining member mounted to the handle, the shank retaining member being moved between engaged and disengaged positions so that a portion of the retaining member projects into the shank channel when the retaining member is in the engaged position so that said portion engages the retaining slot to prevent longitudinal movement of the shank within the shank channel so that the shank is locked in place, and wherein said portion is disengaged from the retaining slot when the retaining member is moved to the disengaged position to allow longitudinal movement of the shank within the channel; and a fastener engagement body releasably joined to the elongate shank for engaging a threaded fastener;

wherein the handle has a race formed therein for receiving the fastener engagement body, the race being sized and configured to frictionally hold the fastener engagement body for storage therein; and the fastener engagement body has a spring-loaded detent that bears against the race when the fastener engagement body is received therein to facilitate holding the fastener engagement body therein.

4. The driver of claim 3, further comprising:

spring biasing means for urging the retaining member to the engaged position.

5. The driver of claim 3, wherein:

there are a plurality of retaining slots spaced along the length of the shank so that the shank can be locked in place at different positions relative to the handle.

6. The driver of claim 3, wherein:

the handle has a generally transverse slot formed therein that intersects the shank channel; and the retaining member is closely received within the transverse slot so that longitudinal forces applied to the retaining member by the shank are transmitted to the handle.

7. The driver of claim 6, wherein:

the retaining member includes a transverse blade pivotally mounted within the slot, the blade having an arm that projects beyond the handle exterior to facilitate movement of the blade to the disengaged position.

8. The driver of claim 3, wherein:

the handle has a rearward grip portion terminating at a rearward end in a heel of the handle and tapering radially inward to a forward neck portion at the forward end, the race extending along the grip portion and having openings at the heel and forward end of the grip portion so that the fastener engagement body can be inserted and removed through the openings of the race, the forward neck portion defining a clearance for insertion and removal of the fastener engagement body.

9. The driver of claim 3, wherein:

the handle has a race access slot that communicates between the exterior of the handle and the race.

10. The driver of claim 3, wherein:

there are a plurality of races, the races being circumferentially spaced apart and extending generally longitudinally along the handle.

11. The driver of claim 3 wherein:

the shank channel extends through the entire length of the handle, and wherein the shank can be removed and inserted into shank channel from either end of the handle.

* * * * *